United States Patent [19]

Stowe

[11] Patent Number: 4,623,021

[45] **Date of Patent: * Nov. 18, 1986**

[54] HYDRAULIC FRACTURING METHOD EMPLOYING A FINES CONTROL TECHNIQUE

[75] Inventor: Lawrence R. Stowe, Plano, Tex.

[73] Assignee: Mobil Oil Corporation, New York, N.Y.

[ * ] Notice: The portion of the term of this patent subsequent to Feb. 18, 2003 has been disclaimed.

[21] Appl. No.: 671,351

[22] Filed: Nov. 14, 1984

[51] Int. Cl.[4] ..... E21B 43/12; E21B 43/267; E21B 49/00

[52] U.S. Cl. ..... 166/250; 166/278; 166/280; 166/281; 166/305.1

[58] Field of Search ..... 73/38, 155; 166/250, 166/263, 278, 280, 281, 305.1, 308, 312

[56] References Cited

U.S. PATENT DOCUMENTS

| | | | |
|---|---|---|---|
| 2,188,936 | 2/1940 | Zeidler, Jr. | 166/305.1 X |
| 2,348,161 | 5/1941 | Duzee | 166/250 X |
| 2,941,597 | 6/1960 | O'Brien | 166/305.1 |
| 2,978,024 | 4/1961 | Davis | 166/280 X |
| 3,022,827 | 2/1962 | Getzen | 166/305.1 X |
| 3,208,528 | 9/1965 | Elliott et al. | 166/305.1 |
| 3,796,264 | 3/1974 | Thigpen, Jr. | 166/305.1 X |
| 4,174,753 | 11/1979 | Graham | 166/307 |
| 4,549,608 | 10/1985 | Stowe et al. | 166/280 |

*Primary Examiner*—George A. Suchfield
*Attorney, Agent, or Firm*—Alexander J. McKillop; Michael G. Gilman; Charles A. Malone

[57] ABSTRACT

A method for controlling fines or sand in an unconsolidated or loosely consolidated formation or reservoir containing hydrocarbonaceous fluids where said reservoir is penetrated by at least one wellbore. The method includes the utilization of hydraulic fracturing in combination with control of the critical salinity rate and the critical fluid flow velocity.

15 Claims, 1 Drawing Figure

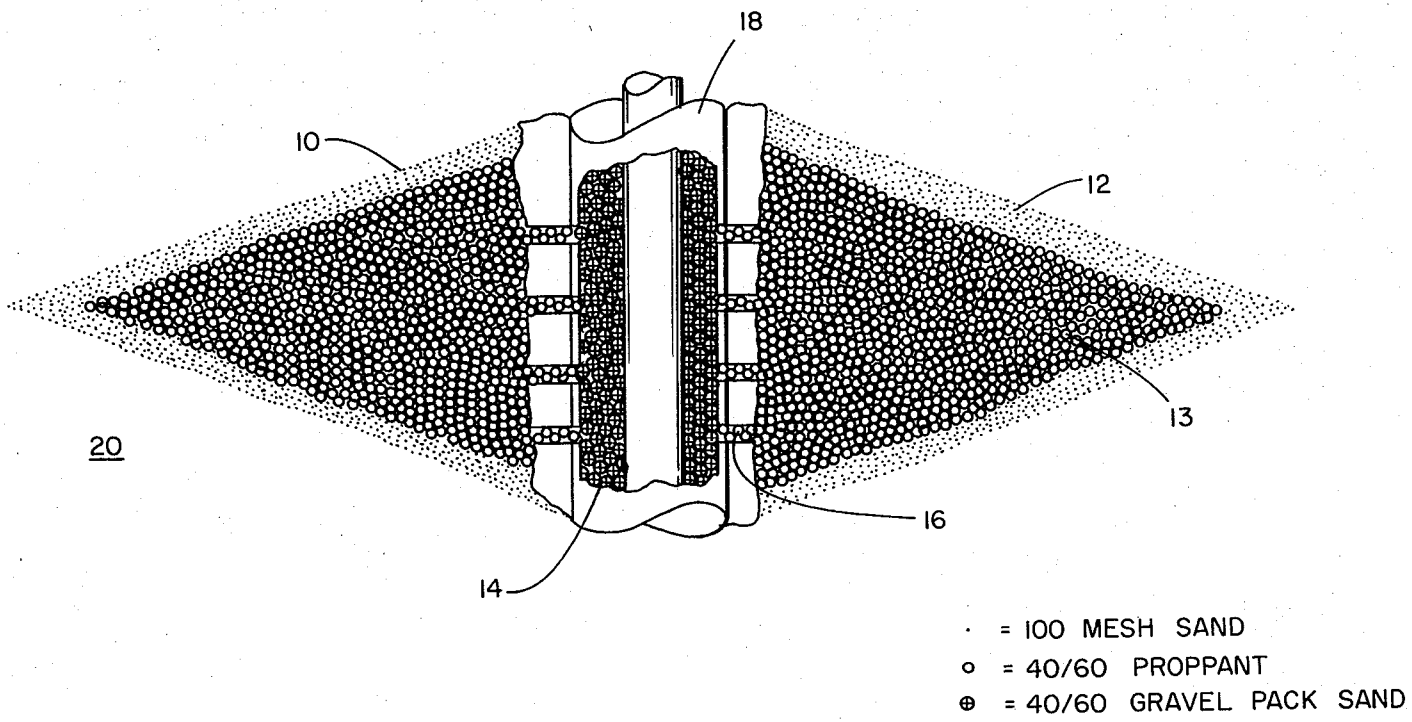
10
12
13
14
16
18
20
· = 100 MESH SAND
o = 40/60 PROPPANT
⊕ = 40/60 GRAVEL PACK SAND

HYDRAULIC FRACTURING METHOD EMPLOYING A FINES CONTROL TECHNIQUE

FIELD OF THE INVENTION

This invention relates to a method for completing a well that penetrates a subterranean formation and, more particularly, relates to a well completion technique for controlling the production of fines from the formation.

BACKGROUND OF THE INVENTION

This application is related to application Ser. No. 622,514 which was filed on June 20, 1984, now U.S. Pat. No. 4,570,710.

In the completion of wells drilled into the earth, a string of casing is normally run into the well and a cement slurry is flowed into the annulus between the casing string and the wall of the well. The cement slurry is allowed to set and form a cement sheath which bonds the string of casing to the wall of the well. Perforations are provided through the casing and cement sheath adjacent the subsurface formation.

Fluids, such as oil or gas, are produced through these perforations into the well. These produced fluids may carry entrained therein fines, particularly when the subsurface formation is an unconsolidated formation. Produced fines are undesirable for many reasons. Fines produced may partially or completely clog the well, substantially inhibiting production, thereby making necessary an expensive workover.

Declines in the productivity of oil and gas wells are frequently caused by the migration of fines toward the wellbore of a subterranean formation. Fines, which normally consist of minutely sized clay and sand particles, can plug and damage a formation and may result in up to a 20-fold, and at times total, reduction in permeability. Conventional sand control techniques such as gravel packing and sand consolidation are sometimes ineffective because fines are much smaller than sand grains and normally cannot be filtered or screened out by gravel beds without a severe reduction in permeability and consolidated sand treatments are restricted to small vertical intervals. In addition, gravel packing and sand consolidation are normally confined to areas surrounding the immediate vicinity of the wellbore. Fines movement, however, can cause damage at points which are deep in the production zone of the formation as well as points which are near the wellbore region.

Normally, these fines, including the clays, are quiescent causing no obstruction to flow to the wellbore by the capillary system of the formation. When the fines are dispersed, they begin to migrate in the production stream and, too frequently, they incur a constriction in the capillary where they bridge off and severely diminish the flow rate.

The agent that disperses the quiescent fines is frequently the introduction of a water foreign to the formation. The foreign water is often fresh or relatively fresh compared to the native formation brine. The change in the water can cause fines to disperse from their repository or come loose from adhesion to capillary walls.

It is well known that the permeability of clay sandstones decreases rapidly and significantly when the salt water present in the sandstone is replaced by fresh water. The sensitivity of sandstone to fresh water is primarily due to migration of clay particles (see "Water Sensitivity of Sandstones," *Society of Petroleum Engineers of AIME,* by K. C. Khilar et al., (Feb. 1983) pp. 55–64). Based on experimental observations, Khilar et al. proposed a mechanism to describe the dependence of water sensitivity in sandstone on the rate of salinity change.

In most reservoirs, a fracturing treatment employing 40–60 mesh gravel pack sand, as in U.S. Pat. No. 4,378,845, will prevent the migration of formation sands into the wellbore. However, in unconsolidated or loosely consolidated formations, such as a low resistivity oil or gas reservoir, clay particles or fines are also present and are attached to the formation sand grains. These clay particles or fines, sometimes called reservoir sands as distinguished from the larger diameter or coarser formation sands, are generally less than 0.1 millimeter in diameter and can comprise as much as 50% or more of the total reservoir components. Such a significant amount of clay particles or fines, being significantly smaller than the gravel packing sand, can migrate into and plug up the gravel packing sand, thereby inhibiting oil or gas production from the reservoir.

Therefore, what is needed is a method of sand control for use in producing an unconsolidated or loosely consolidated oil or gas reservoir while enhancing the production of hydrocarboneaceous fluids.

SUMMARY OF THE INVENTION

The present invention is directed to a method for controlling fines or sand in an unconsolidated or loosely consolidated formation or reservoir penetrated by at least one wellbore where hydraulic fracturing is used in combination with control of the critical salinity rate and the critical fluid velocity.

In the practice of this invention, at least one wellbore is placed into said formation. After perforating the wellbore casing in the desired manner, a hydraulic fracturing fluid is injected into the formation to increase the yield of hydrocarbonaceous fluids from the formation by producing fractures. Subsequently, a proppant is placed into the fracture to prevent its closing. The gravel pack effect of the proppant is improved by injecting ahead of the main body of proppant a sand of a mesh smaller than the propant. This prevents the formation fines or sands from entering into the fracture. A conventional gravel pack is added after fracturing to insure communication between the well-bore and the fracture.

To improve the efficiency of the gravel pack and prevent a compaction of the reservoir fines or sands, the fines or sands can either be fixed in place or transported deep within the formation by controlling the critical salinity rate and the critical fluid flow velocity. In one embodiment, this is accomplished by determining the critical salinity rate and the critical fluid flow velocity of the formation or reservoir surrounding the wellbore. A saline solution is then injected into the formation or reservoir at a velocity exceeding the critical fluid flow velocity. This saline solution is of a concentration sufficient to cause the fines or sand to be transferred and fixed deep within the formation or reservoir without plugging the formation, fracture, or wellbore. Hydrocarbonaceous fluids are then produced from the formation or reservoir at a velocity such that the critical flow velocity is not exceeded deep within the formation, fracture, or wellbore.

It is therefore an object of this invention to prevent the intrusion of fines or sand into an unconsolidated or loosely consolidated formation or reservoir which has been fractured to increase the production of hydrocarbonaceous fluids.

BRIEF DESCRIPTION OF THE DRAWING

The sole drawing FIGURE is a diagrammatic view of a foreshortened, perforated well casing at a location within an unconsolidated or loosely consolidated formation, illustrating vertical perforations, vertical fractures, and fracturing sands which have been injected into the formation to create the vertical fractures in accordance with the method of the present invention.

DETAILED DESCRIPTION OF THE PREFERRED EMBODIMENTS

The method of the present invention will work where there exists one wellbore from which the hydrocarbonaceous fluid is produced as well as where there are two different wellbores, i.e. an injection well and a production well. The method is also applicable to situations in which there exists liquid hydrocarbonaceous production or gaseous hydrocarbonaceous production. Under the proper circumstances, the method is equally applicable to removing hydrocarbonaceous fluids from tar sand formations.

In one embodiment, the formation is fractured in accordance with the method of the present invention to control sand production during oil or gas production. When fracturing with the method taught in U.S. Pat. No. 4,378,845, which is hereby incorporated by reference, oil or gas production inflow will be linear into the fracture as opposed to radial into the well casing.

From a fluidflow perspective, there is a certain production fluid velocity required to carry fines toward the fracture face. Those fines located a few feet away from the fracture face will be left undisturbed during production since the fluid velocity at the distance from the fracture face is not sufficient to move the fines. However, fluid velocity increases as it linearly approaches the fracture and eventually is sufficient to move fines located near the fracture face into the fracture. It is, therefore, a specific feature of the present invention to stabilize such fines near the fracture faces to make sure they adhere to the formation sand grains and don't move into the fracture as fluid velocity increases.

Prior stabilization procedures have only been concerned with radial production flow into the well casing which would plug the perforations in the casing. Consequently, stabilization was only needed within a few feet around the well casing. In an unconsolidated sand formation, such fines can be 30%–50% or more of the total formation constituency, which can pose quite a sand or fines control problem. Stabilization is, therefore, needed a sufficient distance from the fracture face along the entire fracture line so that as the fluid velocity increases toward the fracture there won't be a fines migration problem.

During the injection of the fracture fluid, or in a second injection step, a very small mesh sand 10, such as 100 mesh, is injected. As fracturing continues, the small mesh sand will be pushed up against the fractured formation's face, as shown at 12. Thereafter, a proppant injection step fills the fracture, as shown at 13, with a larger mesh sand, preferably 40–60 mesh. It has been conventional practice to use such a 40–60 mesh sand or other similar quality material for gravel packing. However, for unconsolidated or loosely consolidated sands, a conventional 40–60 mesh gravel pack will not hold out the fines. The combination of a 100 mesh sand up against the fracture face and the 40–60 proppant sand makes a very fine grain gravel pack that will hold out such fines. As oil or gas production is carried out from the reservoir, the 100 mesh sand will be held against the formation face by the 40–60 mesh proppant and won't be displaced, thereby providing for a very fine grain gravel pack at the formation face. Fluid injection with the 40–60 mesh proppant fills the fracture and a point of screen out is reached at which the proppant comes all the way up to and fills the perforation 16 in the well casing 18.

The fracturing treatment of the invention is now completed. Prior to productin, however, it might be further advantageous for sand control purposes to carry out a conventional gravel pack step in the immediate vicinity of the well bore. Such a conventional gravel pack step is assured of extending the packing material right into the fracture, as shown at 14, because the fracturing step has brought the fracture right up the well casing perforations.

As is understood by those skilled in the art, it is not essential to use the 100 mesh sand in the practice of this invention as the fines can be fixed in place, and later moved to other locations within the formation by controlling the salt concentration. To accomplish this, once the fracturing step has been completed and the proppant in place, the critical salinity rate and the critical fluid flow velocity of the formation is determined. This determination is made via methods known to those skilled in the art. One such method is a method as set forth in U.S. Pat. No. 3,839,899 issued to McMillen and which is hereby incorporated by reference. The critical rate of salinity decrease can be determined as referenced in an article authored by K. C. Khilar et al. entitled "Sandstone Water Sensitivity: Existence of a Critical Rate of Salinity Decrease for Particle Capture," which appeared in *Chemical Engineering Science* Volume 38, Number 5, pp. 789–800, 1983. This article is hereby incorporated by reference.

Salts, which can be employed in the practice of this invention include salts such as potassium chloride, magnesium chloride, calcium chloride, zinc chloride, and carbonates thereof, preferably sodium chloride. While injecting the aqueous salt or saline solution of a concentration sufficient to prevent fines migration, pressure is applied to the wellbore which causes the salt solution to be forced deep within the formation. The depth to which the salt solution is forced within the formation depends upon the pressure exerted, the permeability of the formation, and the characteristics of the formation as known to those skilled in the art. In order to allow the fines or sand particles to migrate deeply within the formation 20, the critical fluid flow velocity of the fines is exceeded. This causes the fines, upon their release, to be transported in the saline solution to a location deep within the formation.

As used herein, the critical salinity rate is defined as the fastest rate of salt concentration decrease which will cause the formation fines or particles to become mobile in a controlled manner such that permeability damage is not observed. Lower rates of salt concentration decrease, which cause the fines or particles to dislodge from the formation pore or cavity walls making the fines or particles mobile, are acceptable. The concentration of salt required to obtain the desired effect will vary from formation to formation. Also, the particular salt used will also vary in concentration due to the peculiar characteristics of the formation or reservoir.

As used herein, the critical fluid flow velocity is defined as the smallest velocity of the saline solution which will allow fines or small particles to be carried by the fluid and transported within the formation or reservoir. Lower velocities will not entrain particles and will permit particles to settle from the solution.

As envisioned, the fines are removed to a location deep within the formation.

The practice of this part of the method can begin when the salt concentration of injected fluid is at a predetermined concentration so that the fines will not be mobile and will adhere to the wellbore pores and critical flow channels. The salinity concentration of the injected fluid should then be lowered continually such that the critical rate of salinity decrease is not exceeded and the migration of the fines is kept below the level which would cause a plugging or "log-jam" effect in the flow channels, or fractures. This generally will occur when the salinity of the water surrounding the wellbore and in the formation has become mostly fresh water at a controlled rate. When the proper schedule is determined, pressure is applied to the wellbore and the critical fluid flow velocity is exceeded which causes a reversal in the flow of the hydrocarbonaceous mixture continuing brackish water. Reversal of the fluid flow away from the wellbore and into the formation is continued for a time sufficient to cause the permeability and the critical flow channels near the wellbore to reach the desired level of permeability. The injection time required to reach the desired permeability level is a function of the critical fluid flow velocity, the predetermined schedule for salt concentration decrease, and the projected depth required to permanently deposit the fines. The net effect will be to continually migrate fines deep into the formation without plugging the formation. This migration of the fines away from the wellbore, the fracture, and into the formation continues until the critical flow area around the wellbore and the fracture has been cleaned up.

After determining the permeability characteristics of the formation, the fines can be deposited to a depth in the formation where the rate of hydrocarbon production in the formation is below the critical fluid flow velocity which would cause the fines to migrate to the wellbore. As is known by those skilled in the art, the velocity of fluid flow deep within the formation is less than the velocity of hydrocarbon flow in and around the wellbore since the individual channels surrounding the wellbore contain all of the hydrocarbon production and emanate from all the channels in the formation. Because the volume of the hydrocarbonaceous material in and around the wellbore is a result of the volume of the hydrocarbonaceous material coming from the formation itself, the velocity of the hydrocarbonaceous material near the wellbore is much greater than the velocity of the hydrocarbonaceous material from further or deeper in the formation.

Therefore, the hydrocarbonaceous fluid production is set such that the predetermined level of the critical fluid flow velocity is not exceeded deep within the formation. An excessive production rate would cause an undesired migration of the deposited and pre-existing fines from deep within the formation. Maintenance of the hydrocarbonaceous fluid production at acceptable levels causes the fines to remain deep within the formation and immobile. As is preferred, the rate of hydrocarbon production can now be maintained at rates higher than those expected to cause fines migration under normal operating conditions.

In another embodiment of this invention, fines or particles can be removed from the formation, fracture, and area around the wellbore in a manner to prevent plugging the wellbore. In the practice of this invention, prior to placing the hydrocarbonaceous fluid well into production a fixed concentration saline solution is injected into the formation. The saline solution is of sufficiently low concentration to cause some of the fines or particles to release from the walls and to be transported deep within the formation when the critical fluid flow velocity of the fines or particles is exceeded. Therefore, sufficient injection pressure is applied to the saline solution which causes the critical fluid flow velocity of the fines or particles to be exceeded. The released fines will deposit in the formation when the critical fluid flow velocity of the fines or particles is not exceeded. When the fines or particles have been deposited at the desired depth within the formation, the injection pressure is reduced. A reduction in the injection pressure below the critical fluid flow velocity of the fines or particles, causes the fines or particles to settle out of the solution. Upon settling from the formation the fines adhere to the walls of the pores or channels within the formation.

Once the fines have been deposited deep within the formation, a saline solution, of lower concentration than contained in the first injection, is injected into the formation. The critical fluid flow velocity of the fines or particles is exceeded, causing some of the fines or particles to become mobile. Said fines or particles are released from the formation in a quantity and at a velocity which will not cause a plugging of the critical fluid flow channels, or fractures, near the wellbore. The injection pressure is reduced and the fines settle out deep within the formation. Subsequently, another saline solution, of a still lower concentration than contained in the second injection, is injected into the formation. After reaching the desired depth in the formation, pressure on the saline solution is reduced and the fines settle out.

This procedure of reducing the saline concentration and increasing its flow at a rate to exceed the critical fluid flow velocity of the fines or particles is repeated until the danger of plugging the critical flow channels, fractures, or pores near the wellbore is alleviated. When this point is reached, the procedure is stopped and the well placed back into production.

In another embodiment of this method, the cyclic procedure above can be modified. Instead of forcing the fines or particles deep into the formation and subsequently depositing them, the injection periods are alternated with production periods. Initially, the injection period is maintained for a time sufficient to obtain a limited penetration into the formation. The saline solution concentration and fluid flow is maintained at a concentration and rate sufficient to remove the fines or particles without causing a "log-jam" effect or plugging. After the injection time period, the saline solution containing the released fines is allowed to flow back into the wellbore and the fines are thus removed by pumping them to the surface. In each successive injection, the salt concentration is reduced below the previous level. This procedure is continued until a radial area extending from the wellbore into the formation is cleared of fines or particles at the desired depth or distance within the formation or reservoir. Afterwards production of a hydrocarbonaceous fluid from the formation or reservoir can begin at a fluid flow rate below the critical fluid flow rate of the reservoir or formation.

Obviously, many other variations and modifications of this invention, as previously set forth, may be made without departing from the spirit and scope of this invention as those skilled in the art readily understand. Such variations and modifications are considered part of this invention and within the purview and scope of the appended claims.

What is claimed is:

1. A method for controlling fines or sand in an unconsolidated or loosely consolidated formation or reservoir penetrated by at least one wellbore where hydraulic fracturing is used in combination with control of the critical salinity rate and the critical fluid flow velocity comprising the steps of:

(a) placing at least one wellbore in said reservoir;

(b) hydraulically fracturing said formation via said wellbore with a fracturing fluid which creates at least one fracture;

(c) placing a proppant comprising a gravel pack into said fracture;

(d) determining the critical salinity rate and the critical fluid flow velocity of the formation or reservoir surrounding the wellbore;

(e) injecting a saline solution into the formation or reservoir at a velocity exceeding the critical fluid flow velocity and at a saline concentration sufficient to cause the fines or particles to be transferred and fixed deep within the formation or reservoir without plugging the formation, fracture, or wellbore; and (f) producing a hydrocarbonaceous fluid from the formation or reservoir at a velocity such that the critical flow velocity is not exceeded deep within the formation, fracture, or wellbore.

2. The method as recited in claim 1 where the saline solution is a material selected from the group consistng of potassium chloride, potassium carbonate, calcium chloride, calcium carbonate, magnesium chloride, magnesium carbonate, zinc chloride, zinc carbonate, sodium chloride, or sodium carbonate.

3. The method as recited in claim 1 further including a fine grain sand in said fracturing fluid which is significantly smaller than said gravel packing sand and continuing said hydraulic fracturing so as to push said fine grain sand up against the face of the fractured reservoir, whereby a fine grain gravel pack is produced following the injection of said proppant along the face of said fracture which will prevent the migration of clay particles or fines from said reservoir into said fracture.

4. The method as recited in claim 3 wherein said fine grain sand is no larger than 100 mesh.

5. The method as recited in claim 4 wherein said gravel packing sand is 40–60 mesh.

6. A method for controlling fines or sand in an unconsolidated or loosely consolidated formation or reservoir penetrated by at least one wellbore where hydraulic fracturing is used in combination with control of the critical salinity rate and the critical fluid flow velocity comprising the steps of:

(a) placing at least one wellbore in said reservoir;

(b) hydraulically fracturing said formations or reservoir via said wellbore with a fracturing fluid which creates at least one fracture (c) placing a proppant comprising a gravel pack into said fracture;

(d) determining the critical salinity rate and the critical fluid flow velocity of the formation or reservoir surrounding the wellbore;

(e) injecting a saline solution into the formation or reservoir at a velocity exceeding the critical fluid flow velocity and at a saline concentration sufficient to cause the fines or particles to be transferred and fixed deep within the formation or reservoir without plugging the formation, fracture, or wellbore;

(f) reducing the concentration of the saline solution to less than that required for some fines to be released and exceeding the critical fluid flow velocity sufficient to cause fines or particles to become dislodged from the pore and channel walls and flow from the formation or reservoir at a rate which will not cause plugging or a "log-jam" effect in the critical flow channels in and around the wellbore;

(g) reducing again the concentration of the saline solution and repeating step (f) until substantially all the fines or particles have been deposited deep in the formation or reservoir; and (h) producing a hydrocarbonaceous fluid from the formation or reservoir.

7. The method as recited in claim 6 where the saline solution is a material selected from the group consisting of potassium carbonate, calcium chloride, calcium carbonate, magnesium chloride, magnesium carbonate, zinc chloride, or zinc carbonate.

8. The method as recited in claim 6 further including a fine grain sand in said fracturing fluid which is significantly smaller than said gravel packing sand and continuing said hydraulic fracturing so as to push said fine grain sand up against the face of the fractured reservoir, whereby a fine grain gravel pack is produced following the injection of said proppant along the face of said fracture which will prevent the migration of clay particles or fines from said reservoir into said fracture.

9. The method as recited in claim 8 wherein said fine grain sand is no larger than 100 mesh.

10. The method as recited in claim 9 wherein said gravel packing sand is 40–60 mesh.

11. A method for controlling fines or sand in an unconsolidated or loosely consolidated formation or reservoir penetrated by at least one wellbore where hydraulic fracturing is used in combination with control of the critical salinity rate and the critical fluid flow velocity comprising the steps of:

(a) placing at least one wellbore in said reservoir;

(b) hydraulically fracturing said formation via said wellbore with a fracturing fluid which creates at least one fracture;

(c) placing a proppant comprising a gravel pack into said fracture;

(d) determining the critical salinity rate and the critical fluid flow velocity of the formation or reservoir surrounding the wellbore;

(e) injecting for a substantially short time interval a saline solution into the formation or reservoir in a concentration sufficient to dislodge formation fines or particles;

(f) stoppng the injection of the saline solution and reversing the flow of the saline solution at a flow rate exceeding the critical fluid flow velocity which fluid flow is sufficient to remove the fines or particles from said formation or reservoir without plugging the pores or channels near the wellbore;

(g) injecting into the formation or reservoir a saline solution for a time greater than in step (e) which saline solution is of a concentration lower than step (e) but sufficient to dislodge formation fines or particles;

(h) stopping the injection of the saline solution and reversing the flow of the saline solution at a flow rate exceeding the critical fluid flow velocity sufficient to remove the fines or particles from said formation or reservoir without plugging the pores or channels near the wellbore;

(i) repeating steps (g) and (h) until fines or particles have been removed from the formation or reservoir to a desired depth or distance; and (j) producing a hydrocarbonaceous fluid from the formation or wellbore.

12. The method as recited in claim 11 where the saline solution is a material selected from the group consisting of potassium chloride, potassium carbonate, calcium chloride, calcium carbonate, magnesium chloride, magnesium carbonate, zinc chloride, zinc carbonate, sodium chloride, or sodium carbonate.

13. The method as recited in claim 11 further including a fine grain sand in said fracturing fluid which is significantly smaller than said gravel packing sand and continuing said hydraulic fracturing so as to push said fine grain sand up against the face of the fractured reservoir, whereby a fine grain gravel pack is produced following the injection of said proppant along the face of said fracture which will prevent the migration of clay particles or fines from said reservoir into said fracture.

14. The method as recited in claim 13 wherein said fine grain sand is no larger than 100 mesh.

15. The method as recited in claim 14 wherein said gravel packing sand is 40–60 mesh.

* * * * *